US006554445B1

(12) United States Patent
Jacoby

(10) Patent No.: US 6,554,445 B1
(45) Date of Patent: Apr. 29, 2003

(54) LAMP BODY POUCH

(76) Inventor: Joseph Jacoby, 530 Buttonwood Ave., Maple Shade, NJ (US) 08052

( * ) Notice: Subject to any disclaimer, the term of this patent is extended or adjusted under 35 U.S.C. 154(b) by 0 days.

(21) Appl. No.: 10/052,037

(22) Filed: Jan. 17, 2002

(51) Int. Cl.[7] ..... F21V 21/108

(52) U.S. Cl. ..... 362/108; 362/103; 362/186; 362/191

(58) Field of Search ..... 362/103, 108, 362/186, 190, 191; 2/905, 913, 48

(56) References Cited

U.S. PATENT DOCUMENTS 2,710,338 A * 6/1955 Svalgaard ..... 362/108
4,827,384 A 5/1989 Von Schlemmer
5,070,436 A * 12/1991 Alexander et al. ..... 362/108
5,193,896 A * 3/1993 Oberlander ..... 362/103
6,056,412 A * 5/2000 Atlee et al. ..... 362/103

* cited by examiner

*Primary Examiner*—Stephen Husar
*Assistant Examiner*—John Anthony Ward
(74) *Attorney, Agent, or Firm*—Thomas A. Lennox, Esq.

(57) ABSTRACT

A cloth pouch with a frontal adjustable sized aperture is strappable on the torso of a person adapted to hold and expose through the aperture a dome shaped battery powered lamp that is turned on and off by tapping the dome.

7 Claims, 3 Drawing Sheets

LAMP BODY POUCH

FIELD OF THE INVENTION

This invention involves a device to hold a light generating device on the front of a person allowing the hands to be free to carry out tasks.

BACKGROUND OF THE INVENTION

From early times there has been a continuing need to provide a light that can illuminate the area in front of a person, while allowing the person's hands free to carry out tasks. For the sports of fishing and hunting there is a need to provide a hands free lamp that continually illuminates a major portion of the space to the person's front with broad area of light. One of the early devices used by early miners was a hat that held a candle. Flashlights are very handy, but to allow hand free operation, a device is required to hold them in position. Such devices include various mechanisms to hold pen lights to hats with limited light area coverage, such as U.S. Pat. No. 4,827,384 to Von Schlemmer. Larger lamps on hats would be too burdensome for long term use. Further, attaching a flashlight to a person's headgear, requires that the light beam from the flashlight moves to the side as the person's head moves in that direction. Large battery powered lamps provide enough light to the area in front of a person, but are unwieldy and in the way of carrying out many tasks. If such a lamp is set on the side of the person, shadows interfere with many tasks. Further, such lamps typically do not provide adjustment of the width and size of the illuminated area. Flashlights with a long flexible rear extension that is capable of holding a set position are commercially available. These lights may be curled around a person's head or draped over a person's shoulder to provide hands free operation. However, they do not provide a steady and stable light source if attached loosely on the body. If the extension is attached tightly around the person's neck, it is uncomfortable and the illumination moves as the head moves.

Squat shaped battery powered lamps in the shape of a translucent dome are commercially available that are typically turned on and off by tapping the translucent dome. The dome essentially covers a housing which encloses a lamp, a battery, and a switch mechanism. The battery is operably connected to the lamp and the switch mechanism enables the connection and disconnection of the lamp to the battery by pressing on the dome and moving it in a downwardly direction. These lamps are typically used by merely placing them on a horizontal surface or by attaching them to a vertical wall using two-sided adhesive tape or other mechanism. Alternatively, a dome covered battery powered lamp of essentially the same shape may be provided, but with a side wall of the housing below the translucent dome through which a prominent switch extends allowing the lamp to be turned on and off.

None of the prior art devices answer the above needs and attain the objects stated herein below.

SUMMARY OF INVENTION

For persons fishing from a small boat or the shore and stationary hunting from a blind or a tree stand at low light levels or at night, a soft light over a wide area in front of the person provides ideal illumination to carry out a variety of tasks, including baiting the hook, changing lures, unraveling a line, surf casting, unhooking a fish, loading a rifle or shotgun, eating, dressing an animal and the like. The device of this invention holds an unobtrusive lamp on the person's stomach or chest that provides broad illumination that allows such tasks to be carried out without significant shadows interfering with even delicate tasks. However, circumstances arise when, for a time, the broad area of illumination is not desirable and a narrower beam of light is needed. The device allows the light from a lamp to be narrowed and even essentially hidden with a simple adjustment. When the broad area of illumination is needed again, another simple adjustment uncovers the light. The device includes a pouch of flexible material with a central aperture opening through the pouch frontwardly. The edges of the pouch around the peripheral edge of the aperture are capable of being gathered to adjustably and controllably reduce the size of the aperture and even close the aperture. The terms "gather" and "gathered" are not intended to limit the scope of the invention and are intended to be construed broadly. For example, the aperture may be circular and the "gathering" of the fabric by use of a cord through a casing around the edge of the aperture alternatively closes and opens the aperture. Also, the aperture may be rectangular and preferably square with a plurality of flaps attached around the periphery of the edge of the aperture adapted to be "gathered" by folding them inwardly toward the center of the aperture and toward each other. The term "gather" refers to bringing the peripheral edge of the aperture together.

It is an object of the present invention to provide a device that holds a lamp on the front of a person that does not extend a significant distance frontwardly into the space that would interfere with tasks using the person's hands.

It is an additional object of the present invention to provide a device that holds a battery powered lamp on the front of a person that may easily be turned on and off without removing the lamp from the device.

It is an additional object of the present invention to provide a device that holds a battery powered lamp on the front of a person that provides a broad area of illumination frontwardly from the person.

It is an additional object of the present invention to provide a device that holds a battery powered lamp on the front of a person that allows the person to adjust the diameter of the area of illumination.

It is an additional object of the present invention to provide a device that holds a battery powered lamp on the front of a person that is comfortable and is essentially completely unobtrusive.

It is an additional object of the present invention to provide a device that holds a battery powered lamp on the front of a person that does not move when the person's head moves and provides illumination to the space to the ends of the person's hands held frontwardly with essentially no shadows interfering with fine tasks.

It is an additional object of the present invention to provide a device that holds a battery powered lamp on the front of a person that is secure and does not move even when the person exerts strenuous and quick movements such as surf casting.

An embodiment of this invention is a device for holding a light generating apparatus. The apparatus includes a light transmitting dome on a housing with a light generating means therein, and a switch means in the housing that enables the light generating means to be alternatively turned on and off while the illuminating apparatus remains in the device. The device includes a pouch adapted to hold the light generating apparatus, the pouch including a rear wall and a front wall, a central opening through the front wall with a peripheral edge around the opening, the opening adapted to allow the light transmitting dome of light generating apparatus to extend outwardly through the front wall, and means to alternatively gather the peripheral edge to reduce the size of the central opening and widen the peripheral edge to increase the size of the central opening. The device further includes strap means adapted to hold the pouch on a frontal area of a person with the front wall of the pouch facing outwardly.

It is preferred that the central opening be circular, the peripheral edge is a casing and the means to alternatively gather and widen the peripheral edge include a cord through the casing. It is preferred that the strap means be adapted to adjustably hold the pouch either on a person's chest or abdomen. It is further preferred that the strap means be adapted to hold the pouch on a person's abdomen. It is further preferred that a closable slit opens through the rear wall to enable the light generating apparatus to alternatively be inserted into the pouch and removed from the pouch. It is further preferred that the switch means in the housing be activated by pressing on the dome.

A second embodiment of the invention is a device for holding an illuminating apparatus. The apparatus included a housing with a top opening, a lamp, a battery, and a switch means in the housing, wherein the battery is operably connected to the lamp and the switch means enables the lamp to be alternatively turned on and off while the illuminating apparatus remains in the device, and a light transmitting dome covering the top opening. The device includes a pouch that includes a rear wall and a front wall, a central opening through the front wall with a peripheral edge around the opening, a casing around the peripheral edge with a duct through the length of the casing with adjacent ends of the duct opening frontwardly, a cord threaded through the duct of the casing, the cord having free end sections extending outwardly from the adjacent ends of the duct, wherein pulling the end sections of the cord gathers the peripheral edge to reduce the size of the central opening, and means to releasably hold median portions of the end sections of the cord together to fix a chosen size of the central opening. The device further includes strap means adapted to hold the pouch on an area of a person's front.

DESCRIPTION OF PREFERRED EMBODIMENTS

Figure 1:
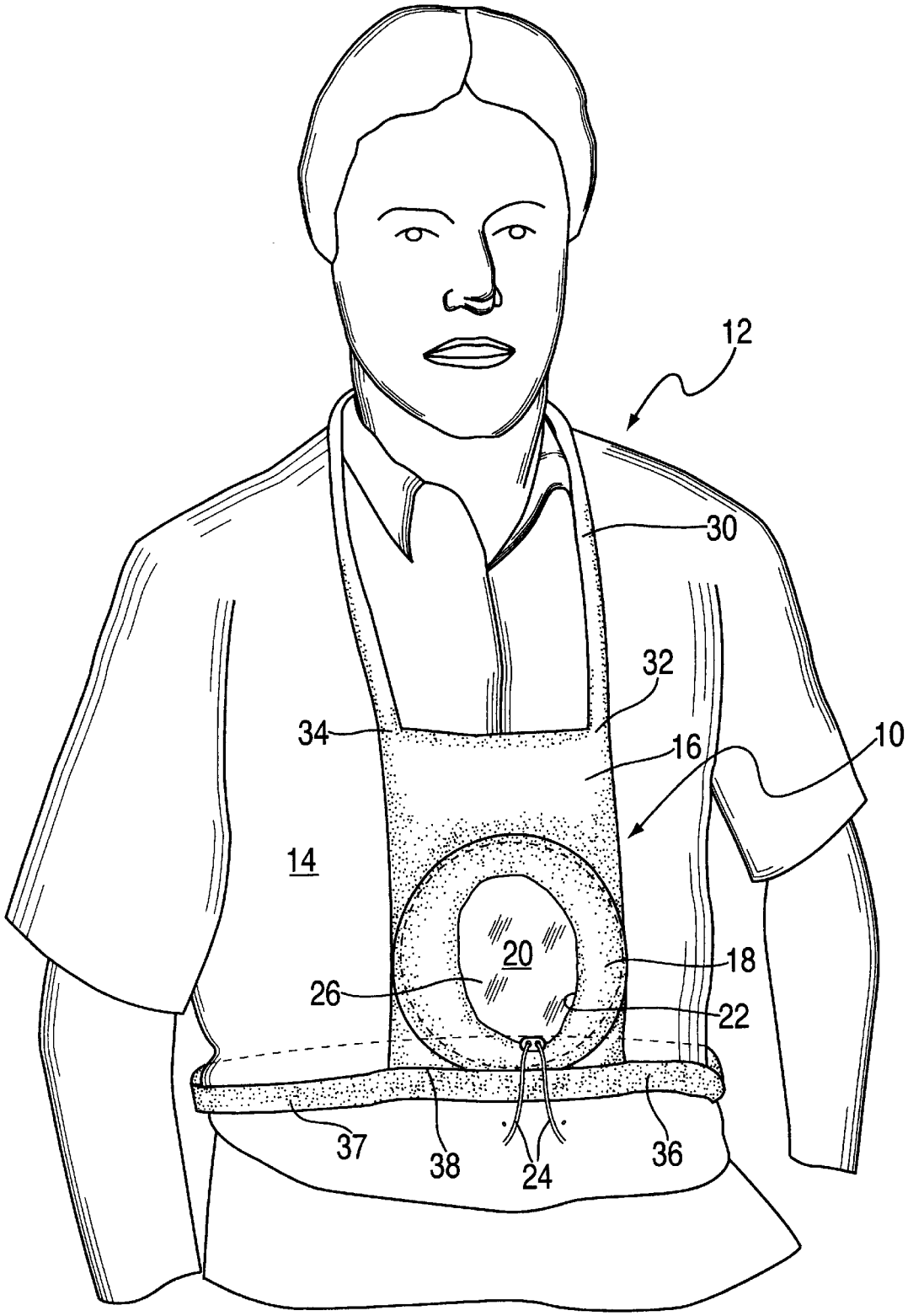
FIG. 1 is a front perspective view of a device of the present invention holding a lamp on the front of a person.
Figure 2:
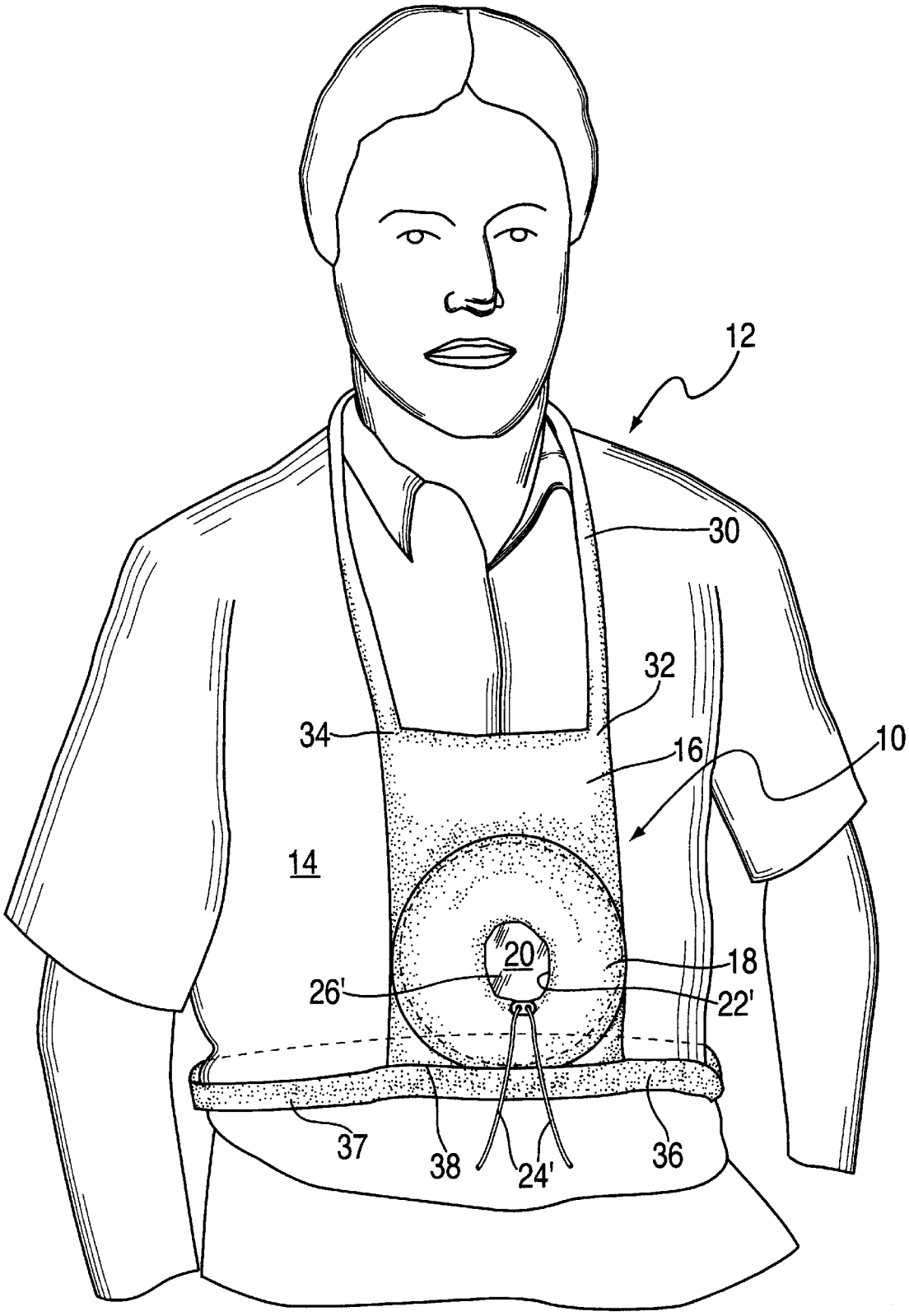
FIG. 2 is a similar view to that of FIG. 1, except that the adjusting cord of the device has been tightened to reduce the size of the pouch opening to narrow the area of light projecting frontwardly.
Figure 3:
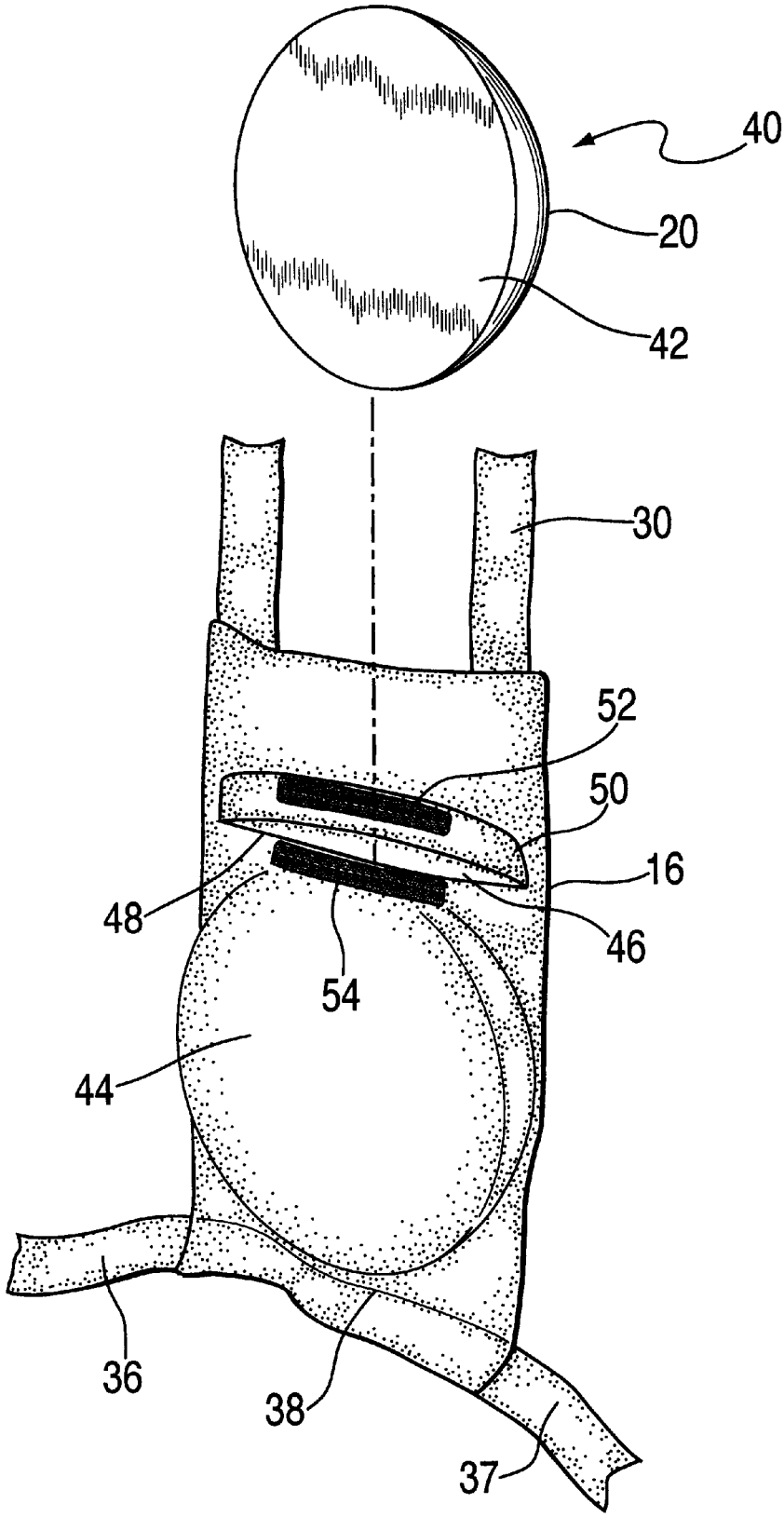
FIG. 3 is a rear perspective view of the device shown in FIG. 1 with the lamp exploded upwardly out of a closable slot in the rear of the pouch.

Device 10 is pictured in FIGS. 1 and 2, strapped on person 12 in the working position. Platform section 16 is positioned over the person's chest or abdomen area 14. Circular pouch 18 is sewn onto section 16 with aperture 26 opening from the interior of pouch 18 frontwardly. Dome cover 20 of battery powered lamp 40 juts out of aperture 26 and light is projected from dome cover frontwardly and to the sides in a wide area in the space frontwardly from the person. Aperture 26 is bounded by peripheral edge 22 which is a casing around the peripheral edge with a duct through the length of the casing with adjacent ends of the duct opening frontwardly. Cord 24 is threaded through the duct of the casings with its free end sections extending outwardly from the adjacent ends of the duct. Locking member 28 is a rigid or semi-rigid plate with two holes spaced apart of a size only slightly larger than the diameter of cord 24. The free ends of cord 24 are threaded through the holes from one side of locking member 28. Alternative locking mechanisms include commercially available plastic balls with a hole through the ball and a spring biased locking member that is released by pressure on a button that extends outwardly from the ball. When member 28 is held and the ends of cord 24 are pulled through, peripheral edge 22 is gathered and opening 26 is narrowed as shown in FIG. 2. Opening 26 is held in place by member 28. Cord 24 may be easily released by pulling on member 28 thereby opening aperture 26 wider. Section 16 is held upwardly on a person's body by neck strap 30, which is connected to upper corners 32 and 34 of section 16 and extends in an upward arc of sufficient size to easily fit over a person's head and hanq around the person's neck on the person's shoulders. The height of positioning pouch 18 on the person's torso may be adjusted by tying a knot in strap 30 or by providing a variety of length increasing and decreasing devices available in commerce including devices not unlike those described above to lock cord 24. Waist straps 36 and 37 are attached to lower edge 38 of section 16 and are of a length to extend around a person's waist and their free ends (not shown) attached together at the person's back either by tying a knot or by a locking mechanism similar to member 28. As shown in FIG. 2, the ends of cord 24' have been pulled and locked by member 28 reducing the circumference of edge 22' and reducing the size of opening 26'. In this configuration the field of light projected from dome cover 20 of the battery powered lamp is reduced in diameter. An alternative to the mechanism described above to adjust the size of the aperture is constructed of cloth. A square aperture is opened in the center of the pouch with a visor cloth section extending outwardly from the top of the opening. The visor is held in place by the stiffness of the fabric and multiple layers. Folding sections are attached the edges of the aperture and are folded inwardly to gather with the adjacent sections to reduce the size and even close the aperture. VELCRO® fasteners secure the sections in various positions, including folded back in the fully open positions and folded forwardly toward the center of aperture to reduce the size of the aperture. In FIG. 3 battery powered lamp 40 is shown exploded out of pouch 18. Commercially available lamp 40, that may be used in device 10 of the invention, is constructed of plastic housing 42 with a front opening.covered by plastic translucent light transmitting convex shaped dome cover 20. Dome cover 20 is free to move into housing 42 and is connected to an internal bayonet switch mechanism (not shown) that is actuated by the movement of dome cover 20 relative to housing, the movement attained by, for example, tapping on dome cover 20. The switch mechanism connects and disconnects a bulb to dry cell batteries all in housing 42 (not shown) turning the lamp on and off. An alternative lamp that may be used in device 10 has an external on-off switch that either extends through a slit cut in front of pouch 18 or is actuated through the cloth material of the pouch. Slit 46 is cut through rear wall 44 into pouch 18. Closure flap 50 drops downwardly over slit 46 engaging hook and eye fabric attaching strips 52 and 54 to close the slit and secure lamp 40 in pouch 18 for use.

Device 12 is constructed of drapable and gatherable fabric such as cotton twill and the various parts are sewn together.

Plasticized polyvinyl chloride film, preferably fabric reinforced, may also be used in constructing device 12. In the circular aperture embodiment above it is necessary that the material used be capable of gathering in edge 22 to allow adjusting the size of aperture 26.

While this invention has been described with reference to specific embodiments disclosed herein, it is not confined to the details set forth and the patent is intended to include modifications and changes which may come within and extend from the following claims.

I claim:

1. A device for holding a light generating apparatus, the apparatus comprising:

(i) a light transmitting dome on a housing with a light generating means therein, and (ii) a switch means in the housing that enables the light generating means to be alternatively turned on and off while the illuminating apparatus remains in the device, the device comprising:

(A) a pouch adapted to hold the light generating apparatus, the pouch comprising:

(a) a rear wall and a front wall, (b) a central opening through the front wall with a peripheral edge around the opening, the opening adapted to allow the light transmitting dome of light generating apparatus to extend outwardly through the front wall, and (c) means to alternatively gather the peripheral edge to reduce the size of the central opening and widen the peripheral edge to increase the size of the central opening, and (B) strap means adapted to hold the pouch on a frontal area of a person with the front wall of the pouch facing outwardly.

2. The device of claim 1, wherein the central opening is circular, the peripheral edge is a casing and the means to alternatively gather and widen the central opening comprises a cord through the casing.

3. The device of claim 1, wherein the strap means is adapted to adjustably hold the pouch either on a person's chest or abdomen.

4. The device of claim 1, wherein the strap means is adapted to hold the pouch on a person's abdomen.

5. The device of claim 1, wherein a closable slit opens through the rear wall to enable the light generating apparatus to alternatively be inserted into the pouch and removed from the pouch.

6. The device of claim 1, wherein the switch means in the housing is activated by pressing on the dome.

7. A device for holding an illuminating apparatus, the apparatus comprising:

(i) a housing with a top opening, (ii) a lamp, a battery, and a switch means in the housing, where in the battery is operably connected to the lamp and the switch means enables the lamp to be alternatively turned on and off while the illuminating apparatus remains in the device, and (iii) a light transmitting dome covering the top opening, the device comprising:

(A) a pouch comprising:

(a) a rear wall and a front wall, (b) a central opening through the front wall with a peripheral edge around the opening, (c) a casing around the peripheral edge with a duct through the length of the casing with adjacent ends of the duct opening frontwardly, (d) a cord threaded through the duct of the casing, the cord having free end sections extending outwardly from the adjacent ends of the duct, wherein pulling the end sections of the cord gathers the peripheral edge to reduce the size of the central opening, and (e) means to releasably hold median portions of the end sections of the cord together to fix a chosen size of the central opening, and (B) strap means adapted to hold the pouch on an area of a person's front.

* * * * *